US006450004B1

(12) United States Patent
Edmondson et al.

(10) Patent No.: US 6,450,004 B1
(45) Date of Patent: Sep. 17, 2002

(54) PRESS BRAKE PUNCH HOLDER

(76) Inventors: Douglas E. Edmondson, P.O. Box 146, Kilbourne, OH (US) 43032; Carl Stover, 6313 State Rte. 37 West, Ostrander, OH (US) 43061

( * ) Notice: Subject to any disclaimer, the term of this patent is extended or adjusted under 35 U.S.C. 154(b) by 0 days.

(21) Appl. No.: 09/971,658

(22) Filed: Oct. 9, 2001

(51) Int. Cl.[7] ..... B21D 37/04

(52) U.S. Cl. ..... 72/482.3; 72/481.1; 72/462; 72/482.2

(58) Field of Search ..... 72/389.4, 481.1, 72/462, 482.2, 448, 389.5, 482.1, 482.3, 482.6

(56) References Cited

U.S. PATENT DOCUMENTS

| | | | | | |
|---|---|---|---|---|---|
| 3,584,497 | A | | 6/1971 | Pohjola | |
| 3,889,515 | A | | 6/1975 | Grombka | |
| 3,965,721 | A | | 6/1976 | Roch | |
| 4,137,748 | A | | 2/1979 | Grombka | |
| 4,315,425 | A | * | 2/1982 | Zbornik et al. | 72/481.6 |
| 4,354,374 | A | | 10/1982 | Deguchi | |
| 4,535,689 | A | | 8/1985 | Putkowski | |
| 4,586,361 | A | | 5/1986 | Reinhorn | |
| 4,612,796 | A | * | 9/1986 | Smyth, Jr. | 72/481.6 |
| 4,653,307 | A | | 3/1987 | Zbornik | |
| 4,736,612 | A | | 4/1988 | Russell | |
| 4,787,237 | A | * | 11/1988 | Houston et al. | 72/462 |
| 4,895,014 | A | | 1/1990 | Houston | |
| 5,009,098 | A | | 4/1991 | van Merksteijn | |
| 5,022,256 | A | * | 6/1991 | Van der Meulen | 72/481.6 |
| 5,121,626 | A | | 6/1992 | Baldwin | |
| 5,305,659 | A | * | 4/1994 | Dieperink et al. | 72/389.5 |
| 5,390,527 | A | | 2/1995 | Kawano | |
| 5,507,170 | A | | 4/1996 | Kawano | |
| 5,511,407 | A | | 4/1996 | Kawano | |
| 5,513,514 | A | | 5/1996 | Kawano | |
| 5,572,902 | A | | 11/1996 | Kawano | |
| 5,619,885 | A | | 4/1997 | Kawano et al. | |
| 5,642,642 | A | | 7/1997 | Kawano | |
| 5,685,191 | A | | 11/1997 | Kawano et al. | |
| 5,782,308 | A | * | 7/1998 | Lattern et al. | 72/481.6 |
| 6,000,273 | A | | 12/1999 | Stover | |
| 6,018,979 | A | | 2/2000 | Davis | |
| 6,032,509 | A | * | 3/2000 | Nagakura | 72/389.5 |
| 6,151,951 | A | * | 11/2000 | Kawano | 72/481.2 |

FOREIGN PATENT DOCUMENTS

| | | |
|---|---|---|
| DE | 616783 | 8/1935 |
| EP | 569880 | 11/1993 |
| JP | 62-267019 | 11/1987 |
| JP | 8-057542 | 3/1996 |
| SU | 1328543 | 3/1988 |

* cited by examiner

*Primary Examiner*—David Jones
(74) *Attorney, Agent, or Firm*—Richard C. Litman

(57) ABSTRACT

A press brake punch holder provides a single actuation assembly to apply symmetrically opposed, lateral forces to a series of otherwise independent punch clamps for securing a corresponding series of punches within the clamps. The clamps are each pivotally secured to the holder assembly by a series of generally centrally disposed bolts therethrough, with the clamps rotating through a limited arc on spherical bearings between the clamps and the holder body. The laterally acting actuator urges the upper ends of the clamps apart, thereby urging their opposite lower ends together to clamp the punches therebetween, or between each clamp and a central structure. Release of lateral pressure allows the punches to be removed as desired, with light spring pressure holding the punches in place when, lateral pressure is removed. Actuation may be provided by a laterally acting wedge assembly, or by laterally acting fluid pressure (hydraulics or pneumatics).

19 Claims, 6 Drawing Sheets

PRESS BRAKE PUNCH HOLDER

BACKGROUND OF THE INVENTION

1. Field of the Invention

The present invention relates generally to large, heavy duty powered metal forming equipment, and more specifically to a punch holder for use with a hydraulically or otherwise powered metal forming press brake. The present punch holder provides for the transfer of mechanical force from a separate activator mechanism to operate a series of otherwise independent punch holder clamps, thereby simultaneously engaging or releasing the press brake punches held therein and greatly reducing the time required for configuration changes.

2. Description of the Related Art

Press brakes are conventionally used in metal forming, particularly for forming bends in relatively large and/or thick sheets of metal. Such brakes are almost universally actuated by hydraulics, but may be powered by other means (mechanical, electromechanical, etc.) as desired. These brakes commonly have a relatively fixed, lower table or bed which carries a metal forming die (or series of dies), and a relatively movable upper ram which holds a series of complementary punches. When the machine is activated, the ram with its punches is forced downwardly into the die or dies, bending any metal placed therebetween.

Punches and dies must frequently be changed due to material and workpiece requirements. While die changes are demanded primarily by material thickness demands, punches are subject to a broader variety of demands. A wide variety of punch profiles, and frequent changeovers, are required to address workpiece demands. With reference to the so-called European style of tooling, multiple independent punch holders function as intermediate spacers between the ram and the punches. These punch holders typically utilize two bolts per punch holder to secure a punch by means of a clamp plate. A ten foot long machine typically utilizes sixteen of these independent punch holders. Thus, it can require the loosening of thirty-two separate bolts to release the entire punch series. The installation of new tools can also require the tightening of thirty-two bolts, in order to secure the new punches. Thus, a total of sixty-four separate mechanical actions may be necessary in order to make a complete punch changeover in such a machine.

Accordingly, a need will be seen for a press brake punch holder system which activates the clamps and secures punches, by means of a single mechanism which acts simultaneously upon all of the punch clamps to secure or release the punches as desired, using a single mechanical motion. Two embodiments of the present punch holder are provided, with a first embodiment using a series of laterally disposed wedges for actuating the clamps, and a second embodiment using fluid means (pneumatic or hydraulic pressure).

A discussion of the related art of which the present inventors are aware, and its differences and distinctions from the present invention, is provided below.

U.S. Pat. No. 3,584,497 issued on Jun. 15, 1971 to William L. Pohjola, titled "Sliding Parallel Ways For Releasing Jammed Press," describes a series of wedges for installation beneath the dies of a metal forming press or the like. The wedges facilitate release of the press pressure in the event the press actuating mechanism becomes caught on dead center, or overcenter, and cannot be released using standard procedures. In this event, the wedges are knocked loose from their positions, thereby relieving the pressure in the press and allowing the press to be reset normally. Pohjola does not disclose any means of engaging or releasing a series of otherwise independent laterally disposed jaws using his wedges in a punch press, nor do his wedges act laterally, as in the present invention.

U.S. Pat. No. 3,889,515 issued on Jun. 17, 1975 to Walter J. Grombka, titled "Wedging Structure For Presses Or The Like," describes a similar structure to that of the Pohjola wedge assembly discussed immediately above. Grombka provides powered hydraulic means for adjusting or releasing the positions of his wedges, as well as hydraulic fluid under high pressure between the surfaces of his wedges and adjacent surfaces for reducing friction therebetween. However, the Grombka wedge assembly still functions essentially like the Pohjola assembly, and cannot operate laterally for actuating a series of punch clamps.

U.S. Pat. No. 3,965,721 issued on Jun. 29, 1976 to Gerald V. Roch, titled "Adjustable Die Holder," describes the use of a series of vertically acting yedges which may be differentially adjusted to compensate for any bending of the die holder bar under-pressure during the bending operation. As in the devices described above, the Roch wedges act vertically, not laterally, and as they are disposed beneath the relatively stationary die, they do not communicate with the multiple punch holder clamps or jaws in any way.

U.S. Pat. No. 4,137,748 issued on Feb. 6, 1979 to Walter J. Grombka, titled "Wedging Structure For Presses Or The Like," describes a wedge system similar to that of his earlier '515 U.S. Patent discussed further above. The wedge structure of the '748 U.S. Patent includes sealing means capable of preventing blowout under the extremely high hydraulic pressures used. However, the system still operates in essentially the same manner as that of his '515 patent, i. e., vertically, rather than laterally, as in the present invention, and does not provide any means of actuating a series of punch clamps.

U.S. Pat. No. 4,354,374 issued on Oct. 19, 1982 to Hideaki Deguchi, titled "Bending Press," describes a longitudinally acting wedge system, i. e., along the length or span of the press, for compensating for flexure of the stationary die during bending operations. The Deguchi apparatus is thus more closely related to that of the Roch '721 U.S. Patent, discussed further above, than to the present invention.

U.S. Pat. No. 4,535,689 issued on Aug. 20, 1985 to Ladislao W. Putkowski, titled "Press With Wedge," describes a system having opposed, longitudinally acting wedges which act to lift the die in the press to compensate for bending of the structure during forming operations. The Putkowski assembly is thus more closely related to that of the Roch '721 and Deguchi '374 U.S. Patents, than to the present invention.

U.S. Pat. No. 4,586,361 issued on May 6, 1986 to Andrei Reinhorn et al., titled "Press Brake Deflection Compensation Structure," describes a wedge system disposed within the stationary bed of the press, rather than in the movable ram portion, as in the present invention. The Reinhorn et al. assembly includes a tension rod for the lower wedge, to adjust the height and bending of the lower plate in the machine. No lateral wedging or dual action for engaging or releasing a series of punch clamps is provided by Reinhorn et al.

U.S. Pat. No. 4,653,307 issued on Mar. 31, 1987 to Vaclav Zbornik, titled "Bending Tool," describes a press brake having a linear series of mutually adjacent vertical pins forming the bottom of the die. The pins are adjusted vertically by a wedge assembly, to achieve the desired height for the base of the die. Thus, Zbornik is only directed to vertical adjustment, and does not provide any means of lateral adjustment nor engagement with the upper punch clamps of the brake, as provided by the present invention.

U.S. Pat. No. 4,736,612 issued on Apr. 12, 1988 to Robert L. Russell, titled "Compensating Die Holder," describes a wedge assembly disposed beneath the relatively stationary die of a punch press or similar machine. The two wedge components are sloped laterally, and while they move laterally relative to one another, the result is vertical adjustment of the upper wedge component, rather than lateral motion of adjusting members, as in the present invention. Russell does not disclose any means of engaging or releasing the punch clamps or jaws in an upper ram assembly, as provided by the present invention.

U.S. Pat. No. 4,895,014 issued on Jan. 23, 1990 to David L. Houston, titled "Failsafe Tool Clamping System For Press Brake," describes various embodiments of a tool clamping system, including a series of laterally acting wedges for both the punch and die. However, the Houston wedges expand outwardly to release the clamping pressure on the punch and die, rather than using lateral expansion to grip the punches, as in the present invention. The present system secures the clamps to the ram by corresponding bolts, which allow the clamps to rock about the fulcrum defined by the bolts. Outward wedging pressure pushes the opposite lower clamp ends together to clamp the punches therein. Houston states that his wedge release action is safer, as loss of hydraulic pressure for driving the wedges results in the tooling remaining clamped in the machine, rather than being released. The present invention responds to this problem by using a series of relatively light springs which urge the clamps to a securing condition even though the wedge has been released. The machine operator may easily overcome the spring pressure by hand to release the tooling. Houston also cites the use of hydraulics for operating his system, but the hydraulic power acts only to drive the wedges to release the clamps, rather than providing a direct fluid action on a laterally moving plate for securing the tooling in the clamps, as provided by the second embodiment of the present invention.

U.S. Pat. No. 5,009,098 issued on Apr. 23, 1991 to Jacobus L. van Merksteijn, titled "Press And Curve-Forming Means Therefor," describes various embodiments employing wedges in the bed of the machine for imparting a bend or compensating for bending loads. The van Merksteijn wedges act in two mutually perpendicular, generally horizontal planes to impart vertical adjustment to the assembly, whereas the present wedges are disposed in vertical planes to act laterally to apply or release clamping force to the upper ends of the punch clamps of the movable upper ram assembly.

U.S. Pat. No. 5,121,626 issued on Jun. 16, 1992 to John B. Baldwin, titled "Adjustable Die Support For A Press Brake," describes a wedge couple having a front to back oriented slope, for adjusting the height of the die or punch assembly. While the movable portion of the wedge assembly moves generally horizontally, the result is a vertical motion, rather than a horizontal motion, as in the case of the present invention. The Baldwin mechanism is more closely related to the mechanism disclosed in U.S. Pat. No. 6,000,273 issued to the second of the present inventors (discussed further below), than to the present invention.

U.S. Pat. No. 5,390,527 issued on Feb. 21, 1995 to Susumu Kawano, titled "Upper Tool Holder Apparatus For Press Brake And Upper Tool Attachable Thereto," describes a tool or punch clamp having an easily manipulable locking and unlocking lever. Kawano also discloses wedge means for adjusting the relative height of each separate tool clamp, but each of his clamps has a separate, independent wedge, unlike the single wedge assembly of the present invention for actuating a series of otherwise independent mechanisms. The Kawano wedge assemblies adjust vertically, rather than wedging horizontally, as in the present invention. Kawano teaches away from the present invention with his separate locking and unlocking handles for each clamp.

U.S. Pat. No. 5,507,170 issued on Apr. 16, 1996 to Susumu Kawano, titled "Upper Tool For Press Brake," describes a variation upon the mechanism of the '527 U.S. Patent to the same inventor, discussed immediately above. The '170 U.S. Patent is a continuation in part of the '527 U.S. Patent, and does not relate any more closely to the present invention than does the '527 parent U.S. Patent.

U.S. Pat. No. 5,511,407 issued on Apr. 30, 1996 to Susumu Kawano, titled "Upper Tool For Press Brake," describes yet another variation on an upper tool clamping mechanism, similar to those of the '527 and '170 U.S. Patents to the same inventor, discussed above. The same points raised in those discussions, are felt to apply here as well.

U.S. Pat. No. 5,513,514 issued on May 7, 1996 to Susumu Kawano, titled "Upper Tool And Upper Tool Holding Device For Press Brake," describes still another variation on an upper tool clamping mechanism, similar to those of the '527, '170, and '407 U.S. Patents to the same inventor, discussed above. The same points raised in those discussions, are felt to apply here as well.

U.S. Pat. No. 5,572,902 issued on Nov. 12, 1996 to Susumu Kawano, titled "Upper Tool Holder Apparatus For Press Brake And Upper Tool Attachable Thereto," describes another variation on an upper tool clamping mechanism, similar to those of the '527, '170, '407, and '514 U.S. Patents to the same inventor, discussed above. The '902 U.S. Patent is a continuation in part of the parent '527 U.S. Patent discussed further above. The same points raised in those discussions, are felt to apply here as well.

U.S. Pat. No. 5,619,885 issued on Apr. 15, 1997 to Susumu Kawano et al., titled "Upper Tool Holder Apparatus For Press Brake And Method Of Holding The Upper Tool," describes another variation on an upper tool clamping mechanism, similar to those of the '527, '170, '407, '514, and '902 U.S. Patents to the same inventor, discussed above. The ''885 U.S. Patent is a continuation in part of the parent '407 and '514 U.S. Patents discussed further above. The same points raised in those discussions, are felt to apply here as well.

U.S. Pat. No. 5,642,642 issued on Jul. 1, 1997 to Susumu Kawano, titled "Upper Tool And Upper Tool Holding Device For Press Brake," describes an additional variation on an upper tool clamping mechanism, similar to those of the '527, '170, '407, '514, '902, and '885 U.S. Patents to the same inventor, discussed above. The '642 U.S. Patent is a continuation in part of the parent '514 U.S. Patent discussed further above. The same points raised in those discussions, are felt to apply here as well.

U.S. Pat. No. 5,685,191 issued on Nov. 11, 1997 to Susumu Kawano et al., titled "Upper Tool For Press Brake," describes a further variation on an upper tool clamping mechanism, similar to those of the '527, '170, '407, '514, '902, '885, and '642 U.S. Patents to the same inventor, discussed above. The '191 U.S. Patent is a continuation in part of yet another U.S. Patent to the same inventor, not cited herein. The same points raised in the discussions of the earlier Kawano U.S. Patents cited further above, are felt to apply here as well.

U.S. Pat. No. 6,000,273 issued on Dec. 14, 1999 to Carl Stover, titled "Press Brake Punch Holder," describes a longitudinally acting (i. e., the width of the machine) wedge mechanism for securing a series of punches in a corresponding series of clamps in the upper portion of a press brake machine. The mechanism of the Stover '273 U.S. Patent operates generally horizontally to lift a clamp actuating mechanism vertically, rather than acting laterally to apply a lateral clamp actuating force, as in the present invention. The device of the Stover '273 U.S. Patent appears more closely related to the fore and aft wedge system of the Baldwin '626 U.S. Patent discussed further above, than to the present invention.

U.S. Pat. No. 6,018,979 issued on Feb. 1, 2000 to Stephen B. Davis, titled "Tool Working Height Adjustment For Press Brake," describes a series of mating pairs of stepped wedges for independently adjusting the height of each punch relative to the ram. Each punch clamp or holder is secured to its own dedicated step wedge pair for independent adjustment. This teaches away from the present invention, with its single wedge assembly providing actuation of all of the punch clamps simultaneously. The Davis assembly is directed to individual height adjustment of the clamps and their punches, rather than providing any means for securing or releasing the punches in their clamps, as provided by the present invention.

German Patent Publication No. 616,783 published on Aug. 5, 1935 illustrates a wedge assembly acting along the width of the machine to compensate for machine structural bending loads during metal bending operations. No means for releasing the punches secured in the machine, is apparent in the drawings. The device of the '783 German Patent Publication thus appears to be more closely related to the mechanisms of the Roch '721 and Deguchi '374 U.S. Patents discussed further above, than to the present mechanism.

Japanese Patent Publication No. 62-267,019 published on Nov. 19, 1987 describes (according to the drawings and English abstract) a cam actuated mechanism for simultaneously releasing or locking all of the punches (upper dies) within the upper ram of a punch press. The device of the '019 Japanese Patent Publication includes a series of individual pivoting levers corresponding to the number of punches which may be used with the press. Each lever has a punch engaging end and an opposite cam engaging end. An eccentric cam extends along the entire width of the machine, with its lobe selectively levering the cam engagement end of each lever downwardly to lock the punch engaging end of the levers against their corresponding punches as the cam is rotated. While this system does accomplish the function of the present invention, i.e., simultaneous engagement or release of all of the punches using a single mechanism, the structure and principle of operation are completely different, in that the mechanism of the Japanese '019 Patent Publication does not accomplish this by means of an internally and longitudinally disposed wedge assembly and pivotally mounted punch holders which are pivotally wedged outwardly to hold their corresponding punches, as is the case of the present invention.

Soviet Patent Publication No. 1,382,543 published on Mar. 23, 1988 describes (according to the drawings and English abstract) a mechanism for use in a stamping machine. A series of helically threaded clamps are tightened selectively to clamp the two plates together. Wedge adjusting means appears to be used, but the wedges appear to adjust the assembly upwardly and downwardly, i. e., vertically, rather than producing any lateral wedge action for selectively securing or releasing any laterally disposed components, as is the case in the present invention.

European Patent Publication No. 569,880 published on Nov. 18, 1993 to Amada Metrecs Company, Limited (Susumu Kawano, inventor) titled "Upper Tool And Upper Tool Holding Device For Press Brake," describes essentially the same device as that disclosed in U.S. Pat. No. 5,619,885 to the same inventor, discussed further above. The '880 European Patent Publication cites most of the same foreign applications as priority, as cited in the '885 U.S. Patent. The same points raised in the discussions of the earlier Kawano U.S. Patents cited further above, are felt to apply here as well.

Finally, Japanese Patent Publication No. 8-057,542 published on Mar. 5, 1996 to Amada Metrecs Co., Ltd. describes (according to the drawings and English abstract) a mechanism very closely related to those of the other U.S. Patents to Kawano (assigned to the same assignee, Amada Metrecs Co.) and the '880 European Patent Publication cited above. It is noted that the first and second inventors shown in the '1542 Japanese Patent Publication (Toshiro Kawano and Mamoro Sugimoto) are also shown respectively as the third and second inventors in the '885 and '191 U.S. Patents cited further above. The same points raised in the discussions of the earlier U.S. Patents to Susumu Kawano and to the same Amada Metrecs assignee cited further above, are felt to apply here as well.

None of the above inventions and patents, taken either singularly or in combination, is seen to describe the instant invention as claimed. Thus a press brake punch holder solving the aforementioned problems is desired.

SUMMARY OF THE INVENTION

The present invention is a punch holder for use with large, power operated industrial press brakes, used for bending large and/or heavy gauge sheet metal. Conventionally, such brakes use "punches" or upper tooling members removably secured within a movable upper ram assembly, which engage the sheet metal sandwiched between the punches and one or more relatively fixed dies. When it is necessary to perform a different bending operation, the punches must be removed and exchanged, with bolts typically being used to secure each punch to the ram assembly. A ten foot long machine typically requires sixteen punch holders, with each punch holder typically being six inches wide. Thus, it may be necessary to remove and replace up to thirty two bolts, if all of the punches must be interchanged.

The present invention responds to this problem by means of a single actuator which acts to simultaneously secure or release all of the otherwise independent punch clamps or holders in a single operation. Two different embodiments are disclosed herein, with a first embodiment using a laterally acting, laterally symmetrical wedge assembly for urging the upper ends of the clamps apart and thus causing the clamps to grip their respective punches as the clamps pivot about their respective fulcrums. A second embodiment uses fluid pressure (pneumatics or hydraulics) to selectively pressurize a sealed flexible chamber, thereby symmetrically applying outward lateral pressure on the upper ends of the clamps.

Accordingly, it is a principal object of the invention to provide a punch holder for a press brake, comprising a single punch clamp activating apparatus communicating with a plurality of otherwise independent punch holding clamps for simultaneously and selectively releasing the clamps by the application or release of a symmetrical lateral force against the upper ends of the pivotally mounted clamps.

It is another object of the invention to provide such a punch holder wherein the lateral force is applied by a laterally acting, symmetrical wedge assembly which selectively drives a plurality of fingers outwardly against the upper ends of the clamps.

It is a further object of the invention to provide such a punch holder wherein the lateral force is applied by a laterally acting, symmetrical fluid activated flexible chamber for applying outward pressure to the clamp actuating fingers.

Still another object of the invention is to provide a punch clamp holding and releasing apparatus including a plurality of relatively light springs for holding the clamps in a secured condition when wedge or fluid pressure is released.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
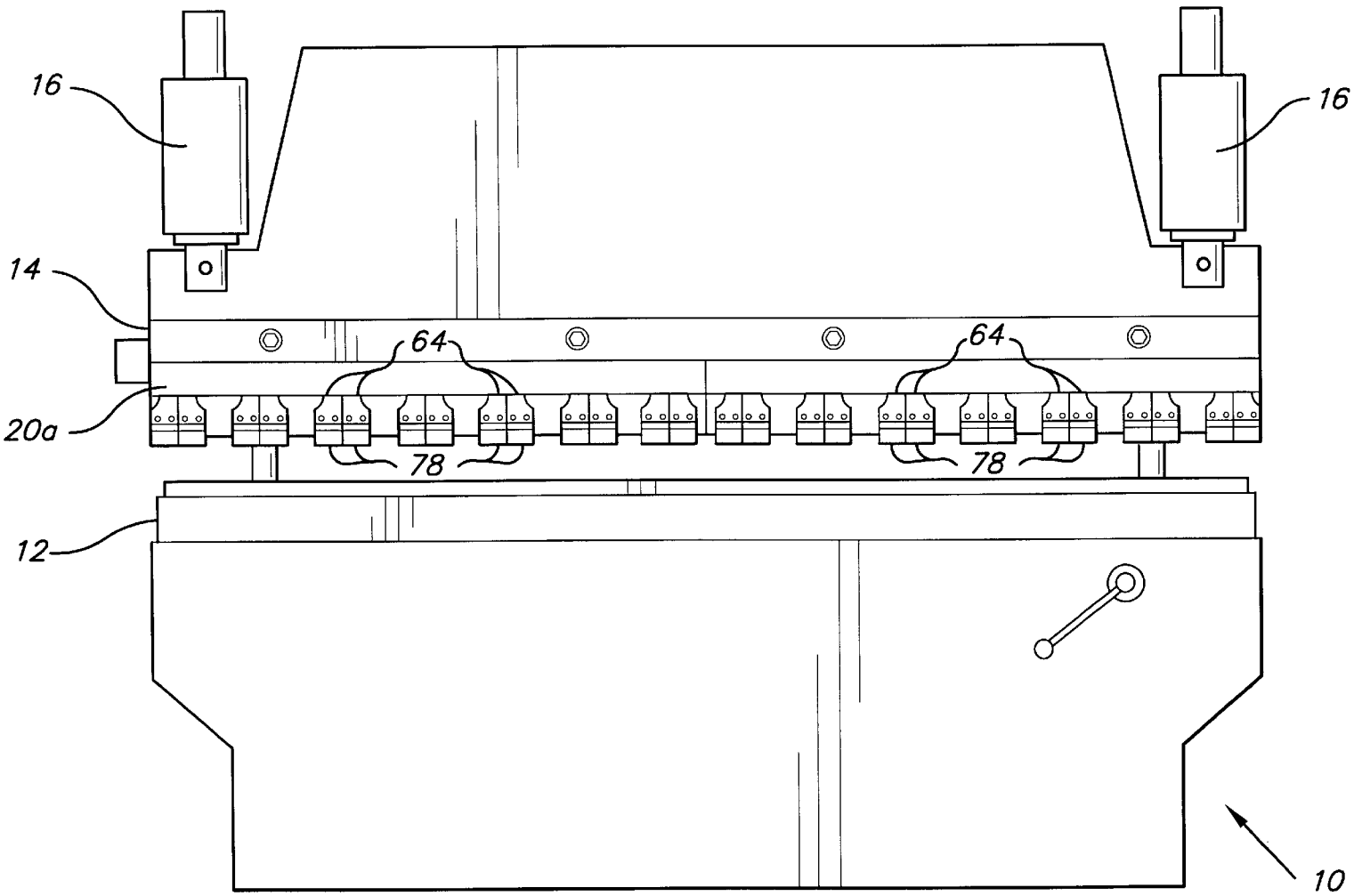
FIG. 1 is a front elevation view of a press brake incorporating the punch holder of the present invention, showing its general features.

The present invention comprises various embodiments of a punch holder for use in relatively sophisticated metal bending press brakes, with an example of such a press brake machine 10 being illustrated in FIG. 1 of the drawings. The press brake 10 is generally conventional, with the exception of the incorporation of the present punch holder mechanism therein. The press brake 10 of FIG. 1 includes an elongate lower die holding bed portion 12, with an elongate ram 14 disposed thereabove for holding a series of punches therein. The ram 14 is movable relative to the lower die holding bed 12, and is actuated by a pair of hydraulic cylinders 16, with one cylinder 16 disposed at each end of the elongate machine 10, generally as shown in FIG. 1 of the drawings. Other alternative actuation means, e. g., electromechanical screw jacks, etc., may be used to actuate the mechanism.

Figure 2:
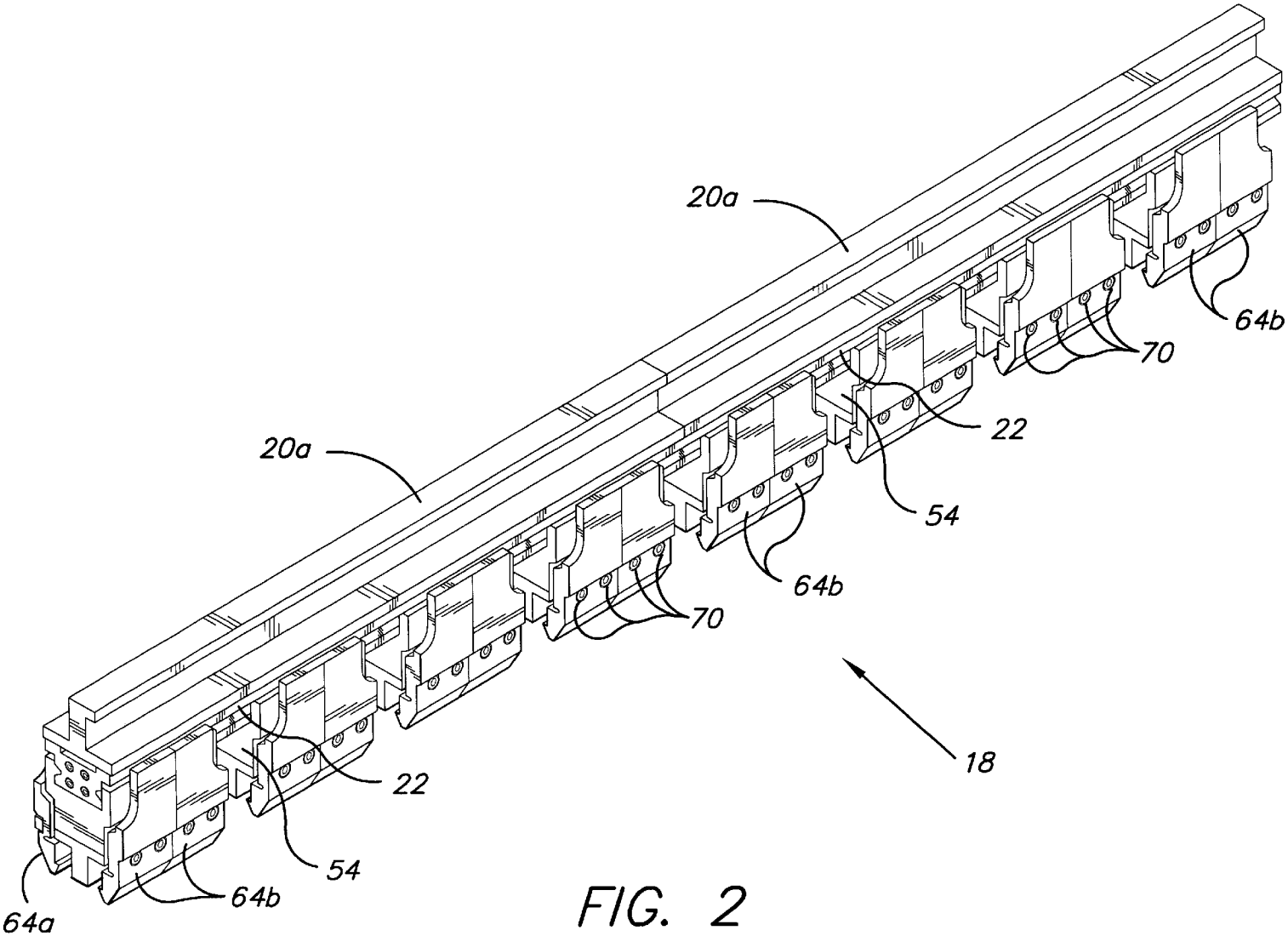
FIG. 2 is a perspective view of a punch clamp assembly incorporating the present punch holder mechanism, showing its general configuration and punch clamp layout and attachment.
Figure 5:
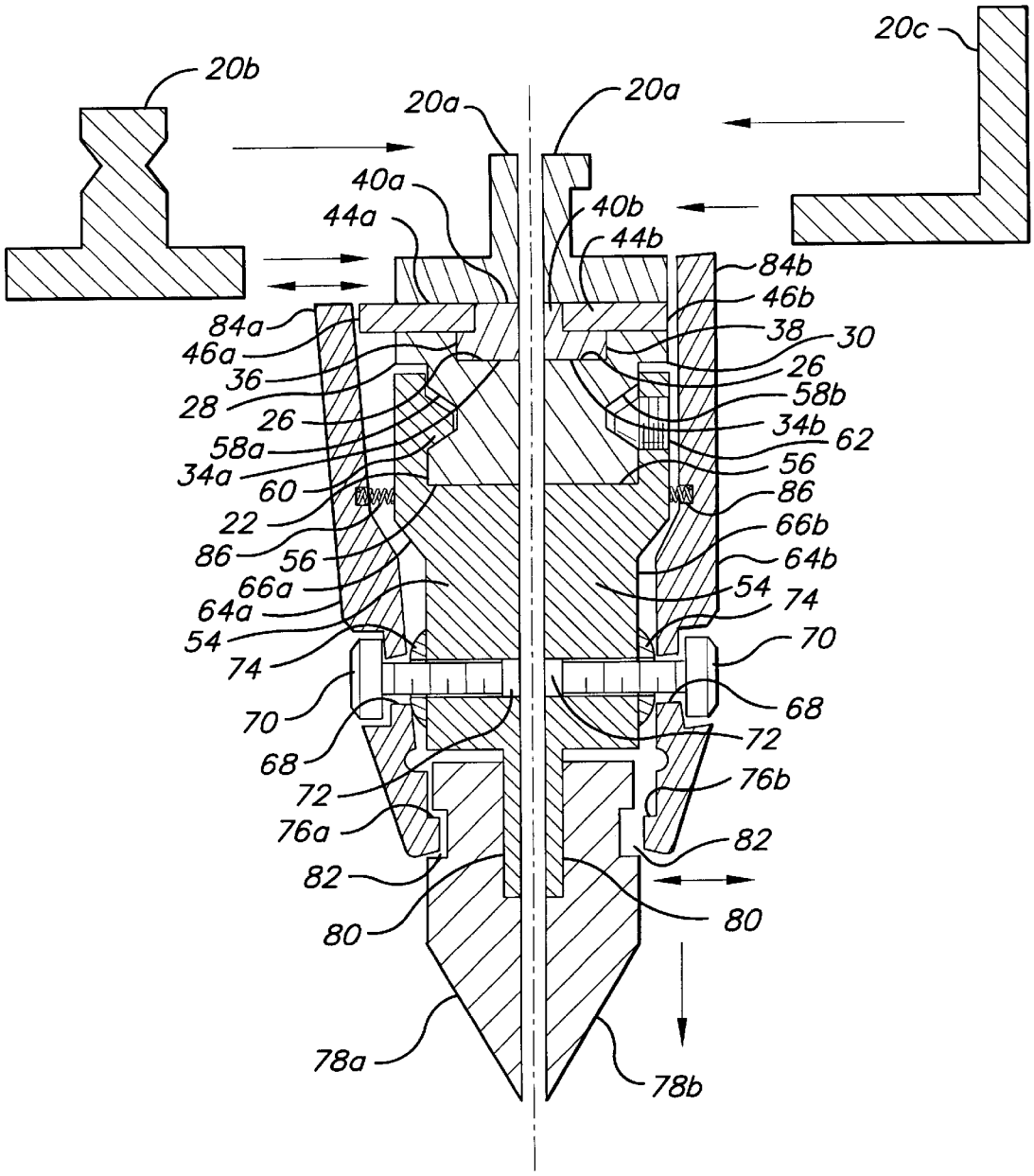
FIG. 5 is an elevation view in section along line 5—5 of FIG. 4 showing the entire assembly, again with the left side activated for clamping the punches and the right side relaxed for releasing the punches.

FIGS. 2 and 5 of the drawings respectively provide perspective and end elevation views in section of the clamp actuator mechanism 18 of the present invention. The clamp actuator mechanism 18 is removably secured to the upper ram 14 by an attachment adapter, designated as adapter 20*a* in FIG. 2 and as the attached adapter in the cross sectional view of FIG. 5. The adapter 20*a* provides for the attachment of the present actuator mechanism 18 to an existing, conventional press brake, e. g., the press brake 10 of FIG. 1. Press brakes are manufactured by various companies, with different manufacturers having different component mounting arrangements. The inverted T cross section adapter 20*a*, with its flanged stem, is suitable for use with many American made machines. However, other press brakes use a Wila style adapter having a generally T shaped cross section with a necked stem, designated as adapter 20*b* in FIG. 5. Still other machines utilize the Amada style adapter 20*c* having a generally L-shaped cross section. The stem of the T or upstanding portion of the L of each of these adapters 20*a* through 20*c*, provides for attachment of the adapter to the appropriate type of press brake, as desired. The flat horizontal portion of the adapter is universal between each of the adapter embodiments 20*a* through 20*c*, and is provided with a series of bolt holes therethrough, for conventionally bolting the clamp actuator assembly 18 to the ram of any practicable type of press brake as desired.

Figure 3:
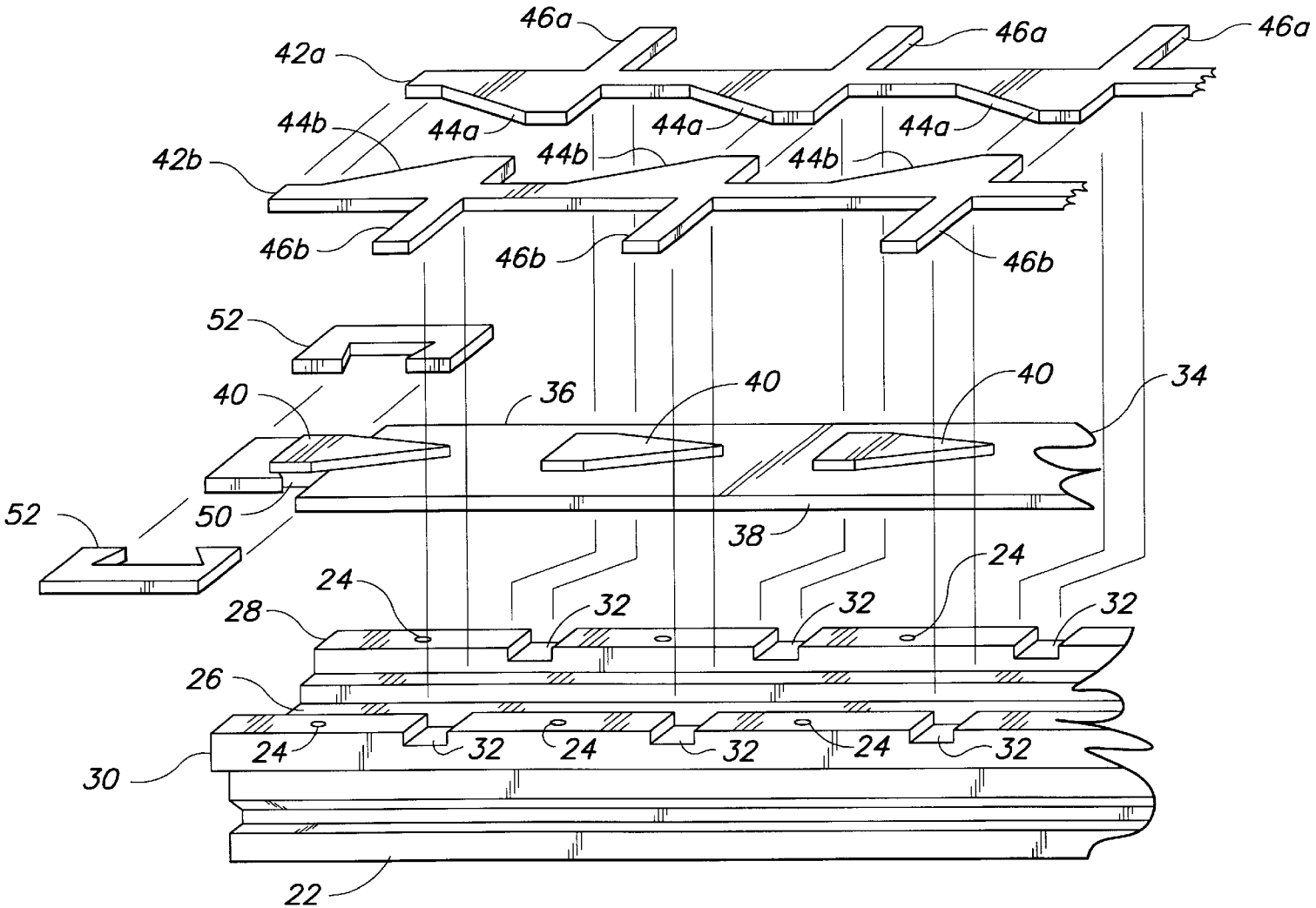
FIG. 3 is an exploded perspective view of the laterally symmetrical wedge punch clamp activation assembly of the first embodiment, showing details thereof.

The adapter is used to secure an underlying elongate actuator housing 22 to the press brake machine. FIG. 3 of the drawings provides an illustration of a portion of the actuator housing 22, with FIG. 5 providing a cross sectional view of the housing 22 and other components of the present invention. The housing is bolted to the overlying adapter by means of conventional bolts which pass through a series of bolt holes 24 (shown in FIG. 3) in the actuator housing 22 and corresponding bolt holes (not shown) in the adapter. The actuator housing 22 is laterally symmetrical, as shown in FIG. 5, and includes an elongate central wedge plate channel 26 disposed between the laterally opposite first and second sides, respectively 28 and 30. Each side 28 and 30 further includes a series of lateral actuator passages 32 extending therethrough.

The wedge plate channel 26 includes an elongate, laterally symmetrical central wedge plate 34 therein, which travels longitudinally within the channel 26. This wedge plate 34 has a first side 36, an opposite second side 38, and a series of flat, triangular, laterally disposed and symmetrical wedge elements 40 extending upwardly from the base plate 34 and toward the first and second sides 36 and 38. A first and a second wedge actuator, respectively 42*a* and 42*b*, are placed atop the wedge plate 34 and are disposed laterally from the central wedge elements 40 of the wedge plate 34. The first and second wedge actuators 42*a* and 42*b* each include a series of inwardly facing first and second wedge members, respectively 44*a* and 44*b*, having angled faces parallel to the angled faces of the central wedge elements 40 of the wedge plate 34 and cooperating with the central wedge elements 40.

Each of the two wedge actuators 42*a* and 42*b* includes a series of laterally extending fingers, respectively 46*a* and 46*b*, extending outwardly therefrom. The fingers 46*a* and 46*b* extend laterally through the actuator passages 32 of the respective first and second sides 28 and 30 of the actuator housing 22, generally as illustrated in the top plan view of FIG. 4. It will be seen that the wedge actuators 42*a* and 42*b* cannot move longitudinally within the actuator housing 22, due to their corresponding fingers 46*a* and 46*b* being captured within the slots or passages 32 of the actuator housing 22.

Figure 4:
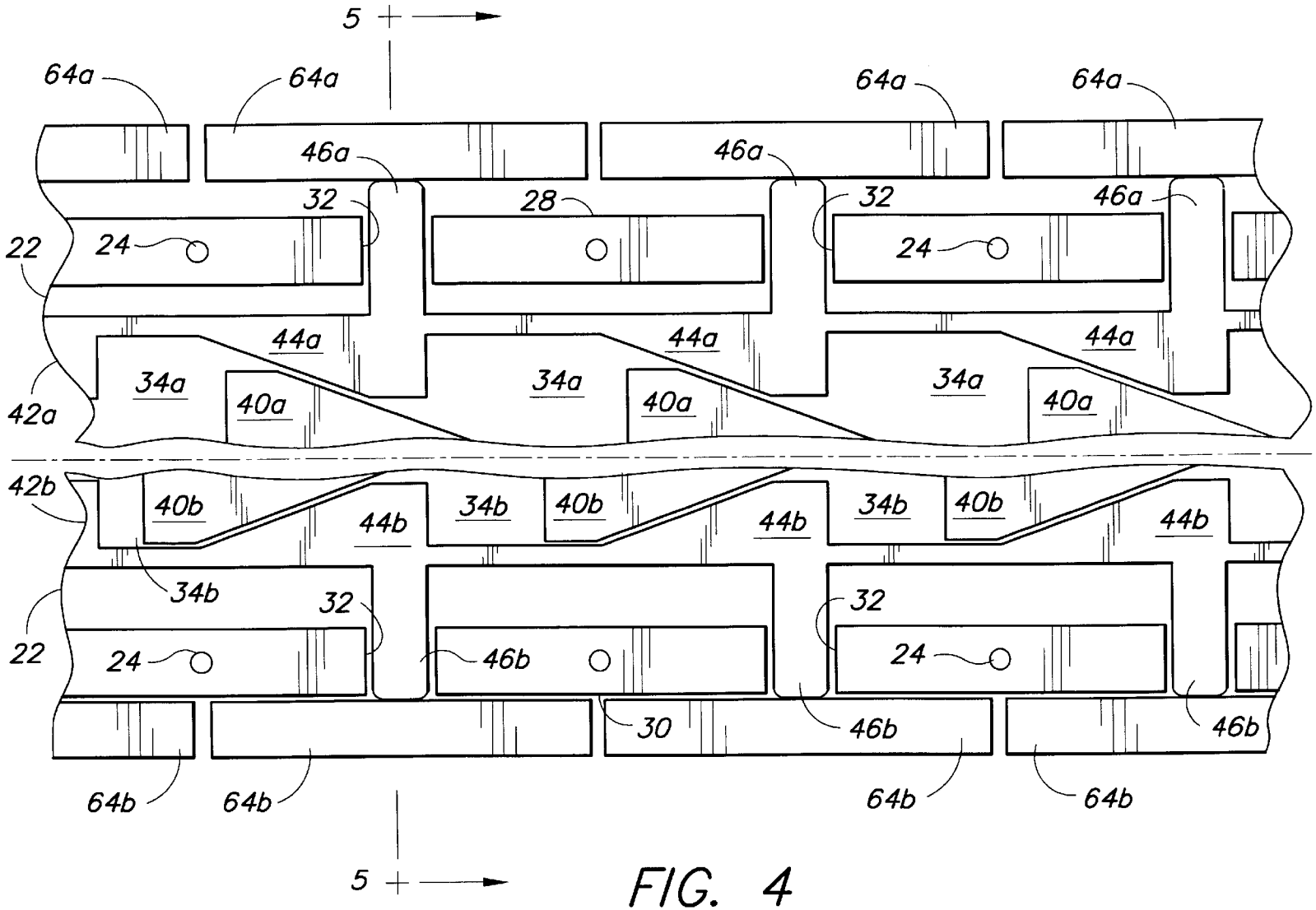
FIG. 4 is a top plan view of the assembled wedge embodiment of FIG. 3, showing the system activated in the upper portion for clamping the punches and with the system relaxed in the lower portion for releasing the punches.

It will be seen that FIG. 4 shows the central wedge plate 34 as two laterally separate components 34*a* and 34*b* for illustrative purposes only, to compare the operation of the present mechanism in a single drawing Figure. The wedge plate 34 in reality comprises a single, monolithic, laterally symmetrical device (or series of longitudinally linked such devices) which actuates both of the laterally disposed wedge actuators 42*a* and 42*b* simultaneously and symmetrically at all times. When the central wedge plate 34 is at rest or in its retracted state, as shown by the wedge plate 34*b* of the lower portion of FIG. 4, the wider portion of each central wedge element 40*b* is adjacent the narrower portion of each corresponding second actuator wedge member 44*b*, thus allowing the second actuator 42*b* and its corresponding fingers 46*b* to retract laterally inwardly toward the center of the actuator housing 22.

However, when the central wedge plate 34 is moved to the right, as shown by the wedge plate portion 34*a* in the upper portion of FIG. 4, the longitudinal movement of the central wedge elements 40*a* drives the wider portions of those elements 40*a* to positions laterally adjacent the wider portions of the complementary actuator wedge members 44*a*, thus pushing the actuator 42*a* laterally outwardly, due to its lack of longitudinal movement as describe further above. As the actuator fingers 46*a* and 46*b* are integral components of their respective actuators 42*a* and 42*b*, this results in the fingers 46*a* of the first actuator 42*a* also moving outwardly through the slots or passages 32 formed through the first side 28 of the actuator housing 22.

The elongate adapter 20*a* (or 20*b*, or 20*c*), actuator housing 22, wedge plate 34, and first and second wedge actuators 42*a* and 42*b*, may each be formed in continuous lengths spanning the entire working width of the press brake 10, if so desired. However, such industrial press brakes often have a working width on the order of eight feet, which would result in impracticably long components for the present punch holder invention. Accordingly, these components may be provided in a series of shorter lengths which assemble end to end, if so desired. No special end configuration or connections are required for the adapters 20*a*, 20*b*, or 20*c* or for the actuator housing 22, as the adapters secure linearly to the ram structure and the actuator housing bolts to the adapters. Also, no special end configuration or connections are required for the two lateral wedge actuators 42*a* and 42*b*, as they cannot move longitudinally due to their respective fingers 46*a* and 46*b* which pass through the slots or passages 32 of the actuator housing 22.

However, some means of securing a series of shorter wedge plate 34 segments together end to end must be provided, if the present punch clamp mechanism is constructed as a series of shorter components. This may be accomplished as shown in FIG. 3 of the drawings, with each end of the wedge plate 34 having a lateral, angular receptacle 50 formed therein, with a pair of longitudinally symmetrical and complementary links 52 serving to join two such wedge plates 34 together end to end. These links 52 transmit all linear motion between a series of shorter wedge plates 34, allowing such a wedge plate 34 series to function as a single unit.

FIG. 5 provides an illustration of the above described assembly installed within the elongate lower clamp attachment bodies 54. The lower bodies 54 each include an elongate upper channel 56 therein, for containing the actuator housing 22 therein. The actuator housing 22 includes a pair of laterally symmetrical grooves 58*a* and 58*b* formed along its length, with each lower body 54 having a mating inwardly extending ridge 60 for securing within the first groove 58*a* of the actuator housing 22. The opposite side of each lower body 54 includes a series of threaded passages formed therethrough, with a series of set screws 62 inserted through the passages to secure into the second groove 58*b* of the lower bodies 54 to secure each lower body 54 to the actuator housing 22, which is in turn bolted to the adapter 20*a* (or 20*b* or 20*c*) which secures to the ram 14 of the press brake 10.

A series of identical but mutually independent punch clamps or holders 64 is secured laterally along the opposite sides 66*a* and 66*b* of the lower bodies 54, with the first sides 66*a* having a series of first clamps 64*a* attached thereto, and the opposite second sides 66*b* having a series of second clamps 64*b* attached 20 thereto. It will be seen that only a single series of clamps 64*a* or 64*b* need be used if so desired, depending upon the configuration of the punches to be used, the specific requirements for the bend(s) to be produced, etc. However, two sets of punch clamps or holders 64*a* and 64*b* are illustrated in the vertically split view of FIG. 5, in order to illustrate the operation of the present invention more clearly.

Each of the punch clamps or holders 64*a* and 64*b* includes a pair of passages 68 formed generally medially therethrough, and laterally separated from one another. A clamp pivot bolt 70 is inserted through each passage 68, and threaded into a cooperating passage 72 in the corresponding lower body 54 to removably secure the clamps or holders 64*a* and 64*b* to the lower bodies 54. A convex bearing 74 is preferably provided between each clamp or holder 64*a* and 64*b* and the respective side 66*a* and 66*b* of its lower body 54, in order to allow the clamps 64*a* and 64*b* to rock or pivot about the axis or fulcrum defined by the two pivot bolts 70 securing each clamp 64*a* and 64*b* to its respective lower body 54.

The lower punch gripping end of each punch clamp or holder 64*a* and 64*b* has an inwardly facing (when the clamp is secured to the lower body) punch retaining extension, respectively 76*a* and 76*b*, extending therefrom, for securing a metal bending punch 78 (78*a* or 78*b*, in FIG. 5) between the extension 76 and a depending central extension 80 of the lower body 54. Each punch 78*a* and 78*b* includes a slot 82 formed therein, for insertion of a corresponding punch clamp extension 76 therein to secure the punches 78*a* or 78*b* to the assembly. It will be understood that the punches 78*a* or 78*b* may be asymmetrical as shown in FIG. 5, with only one series of punches 78*a* or 78*b* being installed in the machine at any given time. Alternatively, the punches 78*a* and 78*b* may be formed as a series of single, laterally symmetrical components if so desired, depending upon the specific structure of the press brake machine, the specific bend to be formed in the sheet metal being worked, etc.

Each of the punch clamps 64*a* and 64*b* has an upper actuating end, respectively 84*a* and 84*b*, opposite the lower punch gripping extension ends 76*a* and 76*b*. These actuating ends 84*a* and 84*b* are disposed immediately outwardly of the respective first and second sides 28 and 30 of the actuator housing 22. The fingers 46*a* and 46*b* of the two wedge actuators 42*a* and 42*b*, selectively extending through their respective actuator passages or slots 32, contact the upper ends 82*a* and 82*b* of the punch holders 64*a* and 64*b*, in order to secure or release the punches 78*a* and/or 78*b* held thereby.

The left side of FIG. 5 illustrates the configuration of the above described assembly when the central wedge plate 34 is driven to push the lateral wedge actuators, e. g., wedge actuator 42*a*, outwardly, as shown in the upper half of the top plan view of FIG. 4. As the wedge plate 34 is driven along the channel 26 of the actuator housing 22, the two wedge actuators (e. g., the wedge actuator 42*a* in FIGS. 4 and 5) are driven laterally outwardly, thereby pushing their laterally extending fingers (e. g., left side fingers 46*a*, in FIGS. 4 and 5) outwardly as well. The outwardly extended fingers 46*a* bear against the upper actuating ends 84*a* of the punch holders or clamps, e. g., clamps 64*a*, pushing them laterally outwardly away from the actuator housing 22 and lower bodies 54. As the punch clamps are pivotally secured to the lower bodies 54 by the bolts 70, this results in the opposite lower ends of the clamps, e. g., lower end 76*a* on the left side of FIG. 5, pivoting inwardly to grip the slot 82 of the punch 78*a*, thereby retaining the punch in position on the assembly.

The punches are released by an opposite longitudinal, linear motion of the central wedge plate 34, in accordance with the position of the wedge plate 34*b* in the bottom portion of FIG. 4, and in the right side of FIG. 5. When the wedge plate 34 is pulled to the left, as in the wedge plate 34*b* of the lower portion of FIG. 4, the two lateral wedge actuators (e. g., the second wedge actuator 42*b* of FIG. 4) may be moved inwardly, as a space will open between the mating wedge surfaces of the central wedge elements 40 and the lateral actuator wedge members 44.

However, the punch clamps 64 will remain in their normal, clamping positions as shown on the left side of FIG. 5, due to a series of light compression springs 86 disposed between the upper portions of the clamps 64*a* and 64*b*, and their lower bodies 54. These springs 86 continue to hold the upper portions of the clamps outwardly, thereby holding the lower punch retaining end inwardly to grip the punch retained therein, until a laterally inward force is applied to the upper portion of the punch retaining clamp or holder. This assures that the punches cannot fall from their secured positions when the system is deactivated to allow the release of the punches. When removal of the punches is desired, the press brake operator need only grasp the punch to be removed and apply a light inward pressure to the top of the punch holder, pivoting the upper end of the punch holder laterally inwardly, as in the upper ends 84*b* of the punch holders 64*b* of the lower portion of FIG. 4 and right side of FIG. 5. This allows the selected punch, e. g., 78*b* in FIG. 5, to be removed from the assembly.

Figure 6:
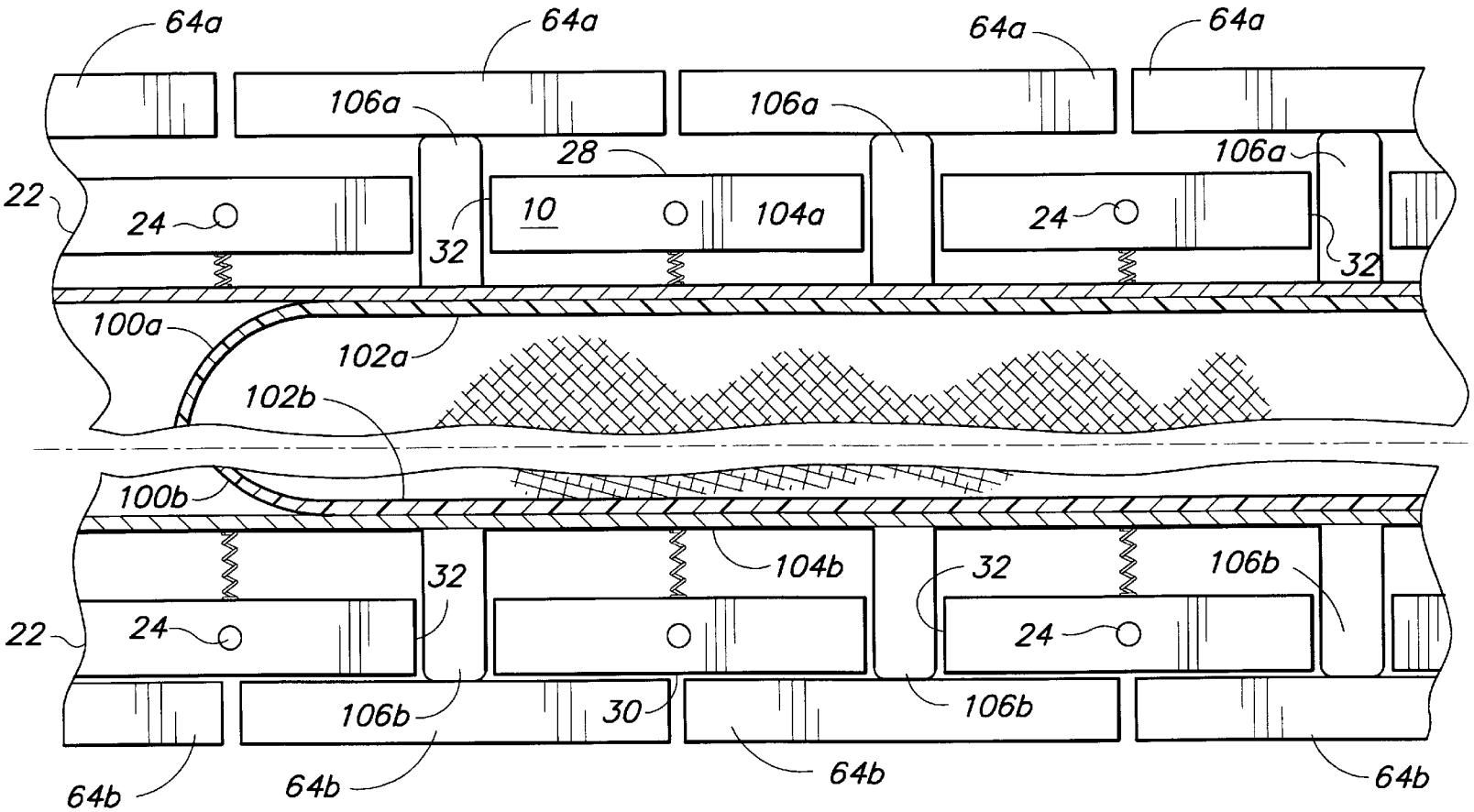
FIG. 6 is a top plan view of a second embodiment incorporating fluid clamp activation means, with the left side inflated to clamp the punches and the right side deflated for releasing the punches.

FIG. 6 illustrates a schematic, top plan view of an alternative embodiment of the present invention, utilizing fluid (i. e., pneumatic or hydraulic) pressure for punch clamp retention. The embodiment of FIG. 6 is divided into an actuated, punch holding configuration in the upper portion of the Figure, and a deactivated or punch release configuration in the lower portion of the Figure in the same manner as that used to show the operation of the first embodiment system in FIG. 4 of the drawings. The actuator housing 22 is essentially the same in both embodiments, i. e., comprising a hollow channel for the actuator. The two sides 28 and 30 each include a series of bolt holes 24 therein, for bolting the adapter 20*a*, 20*b*, or 20*c* thereto, in the manner described further above for the embodiment of FIGS. 3 through 5. A series of punch clamps, e.g., clamps 64*a* along the upper side and 64*b* along the lower side of FIG. 6, is secured to the lower body portions in the manner illustrated in FIGS. 2 and 5 and described further above.

The punch clamp actuator assembly of the embodiment of FIG. 6 includes at least one elongate, flexible, selectively inflatable fluid chamber 100*a* (for the upper portion or 100*b* (for the lower portion) therein, with the chamber 100*a*, 100*b* having a first side 102*a* and an opposite second side 102*b*. The chamber 100*a*, 100*b* may comprise a series of relatively shorter, longitudinally aligned and interconnected chambers, if so desired. A pressure plate, respectively 104*a* and 104*b*, is disposed along the corresponding sides 102*a* and 102*b* of the pressure chamber 100*a*, 100*b*.

Each pressure plate 104*a*, 104*b* includes a series of fingers, respectively 106*a* and 106*b*, extending laterally therefrom. These fingers 106*a* and 106*b* extend through the actuator passages or slots 32 of the actuator housing 22, in essentially the same manner as that described above for the first embodiment of the present invention and illustrated in FIGS. 5 and 5 of the drawings.

Activation of the system of FIG. 6 comprises pressurizing the chamber using an appropriate fluid (pneumatic, hydraulic, etc.), as shown by the expanded chamber side 100*a* in FIG. 6. This presses the pressure plate, e. g., plate 104*a*, laterally outwardly, extending the corresponding fingers 106*a* outwardly through the slots or passages 32 of the actuator housing 22, thereby pushing the upper ends of the punch clamps, e. g., clamps 64*a*, outwardly to move their opposite ends inwardly to grip the punches therein, generally as shown in the left side of FIG. 5.

When it is desired to release the punches, the pressure in the bladder or chamber is released, as shown in the lower bladder or chamber portion 100*b* of FIG. 6. The chamber 100*b* is deflated by means of a series of compression springs 108 between the side walls 28 and 30 of the housing 22 and the corresponding pressure plates 104*a* and 104*b*, which urge the plates 104*a* and 104*b* toward the center of the housing 22, thereby deflating the chamber as shown with the chamber portion 100*b* in the lower portion of FIG. 6. This allows the press brake operator to push the upper ends of the punch clamps inwardly, as shown with the clamps 64*b* of FIG. 6, thereby releasing the punches as shown in the right side of FIG. 5.

In conclusion, the present press brake punch holder invention provides a novel means of transferring mechanical force from an activator mechanism which is separate from and independent of the punch holders, but which communicates mechanically with the multiple punch holders to provide simultaneous clamping relaxation of clamping pressure for the entire punch series in the machine. Activation may be achieved by any conventional mechanical, hydraulic, or electrical means (e. g., screw jacks, hydraulic pistons, etc. for advancing the central wedge plate). The present invention provides additional advantages, in that the forces directed to the bending of metal being worked in the press brake, are directed away from the internal punch securing and releasing mechanism. The ability to link a series of separate components together linearly, provides great versatility for virtually any size machine, with the series of adapters for machines of different manufacture providing even further versatility.

Using the present invention, a press brake operator may easily install and remove punches from the machine, using only a single, simple operation to activate the mechanism. No tools or tedious removal and securing of a multitude of bolts is required, as in conventional machines. The present invention will thus provide significant savings in time and labor, and therefore expenses, in the setup and operation of a press brake machine for virtually any job, thereby providing significant economies of operation.

It is to be understood that the present invention is not limited to the embodiments described above, but encompasses any and all embodiments within the scope of the following claims.

We claim:

1. A press brake punch holder for attaching at least one punch to a reciprocating ram of a press brake, comprising:

an elongate actuator housing having ram attachment means for attachment to the ram of a press brake;

a plurality of punch clamp attachment bodies removably affixed to and depending from said actuator housing;

a plurality of laterally disposed, mutually separate and independent punch clamps pivotally and removably secured to each of said punch clamp attachment bodies;

each of said punch clamps having an upper actuating end, a lower punch gripping end, and a generally centrally disposed fulcrum therebetween; and at least one elongate, laterally operating punch clamp actuator assembly disposed within said actuator housing, selectively communicating laterally with said upper actuating end of each of said punch clamps for urging said upper actuating end of each of said punch clamps laterally outwardly and thereby urging said lower punch gripping end of each of said punch clamps laterally inwardly in order to selectively grip the at least one punch.

2. The press brake punch holder according to claim 1, wherein said punch clamp actuator assembly comprises:

at least one elongate, laterally symmetrical, longitudinally traveling central wedge plate having a first side, a second side opposite said first side, and a plurality of laterally disposed wedge elements extending to said first side and to said second side;

at least one first wedge actuator laterally disposed to the first side of said central wedge plate, and communicating therewith by a cooperating series of laterally disposed first wedge members;

at least one second wedge actuator laterally disposed to the second side of said central wedge plate, and communicating therewith by a cooperating series of laterally disposed second wedge members;

said actuator housing further including a first side and a second side opposite said first side, each having a plurality of laterally disposed actuator passages therethrough; and each said wedge actuator further including a plurality of laterally extending fingers disposed through said actuator passages of said actuator housing in order to communicate with said upper actuating end of each of said punch clamps, for urging said upper actuating end of each of said punch clamps away from said actuator housing when said central wedge plate is driven between said first and said second wedge actuator, wedging each said wedge actuator and corresponding said fingers laterally outwardly from said actuator housing.

3. The press brake punch holder according to claim 2, wherein at least said central wedge plate comprises a plurality of longitudinally linked components.

4. The press brake punch holder according to claim 1, wherein said punch clamp actuator assembly comprises:

at least one elongate, flexible, selectively inflatable fluid chamber having a first side and opposite second side;

a first pressure plate disposed to said first side of said fluid chamber, and a second pressure plate disposed to said second side of said fluid chamber;

said actuator housing further including a first side and a second side opposite said first side, each having a plurality of laterally disposed actuator passages therethrough; and each said pressure plate having a plurality of laterally extending fingers disposed through said actuator passages of said actuator housing and communicating with said upper actuator end of each of said punch clamps, for urging said upper actuator end of each of said punch clamps away from said actuator housing when said at least one fluid chamber is selectively inflated, urging each said pressure plate and corresponding said fingers laterally outwardly from said actuator housing.

5. The press brake punch holder according to claim 1, further including a convex bearing disposed between each of said punch clamp attachment bodies and corresponding said punch clamps.

6. The press brake punch holder according to claim 1, wherein:

said actuator housing and each of said punch clamp attachment bodies are each laterally symmetrical and each includes a first side and a second side opposite said first side; and said punch clamps are laterally and generally symmetrically disposed along both said first side and said second side of each of said punch clamp attachment bodies.

7. The press brake punch holder according to claim 1, further including a light compression spring disposed between said upper actuating end of each of said punch clamps and corresponding said punch clamp attachment bodies, for retaining the at least one punch for manual removal when said punch clamp actuator assembly is released.

8. The press brake punch holder according to claim 1, wherein said ram attachment means comprises:

an attachment adapter adapted for attachment between a press brake ram and said actuator housing, for removably securing said actuator housing to the ram, said attachment adapter having a configuration adapted for attaching to the ram and precluding requirement for modification to said actuator housing for attachment to the ram.

9. A press brake punch holder for attaching at least one punch to a reciprocating ram of a press brake, comprising:

an elongate actuator housing having ram attachment means for attachment to the ram of a press brake;

a plurality of punch clamp attachment bodies removably affixed to and depending from said actuator housing;

a plurality of laterally disposed, mutually separate and independent punch clamps pivotally and removably secured to each of said punch clamp attachment bodies;

each of said punch clamps having an upper actuating end, a lower punch gripping end, and a generally centrally disposed fulcrum therebetween;

at least one elongate, laterally symmetrical, longitudinally traveling central wedge plate disposed within said actuator housing;

said at least one wedge plate having a first side, a second side opposite said first side, and a plurality of laterally disposed wedge elements extending to said first side and to said second side;

at least one first wedge actuator laterally disposed to said first side of said central wedge plate, and communicating therewith by a cooperating series of laterally disposed first wedge members;

at least one second wedge actuator laterally disposed to said second side of said central wedge plate, and communicating therewith by a cooperating series of laterally disposed second wedge members;

said actuator housing further including a first side and a second side opposite said first side, each having a plurality of laterally disposed actuator passages therethrough; and each said wedge actuator having a plurality of laterally extending fingers disposed through said actuator passages of said actuator housing and communicating with said upper actuating end of each of said punch clamps, for urging said upper actuating end of each of said punch clamps away from said actuator housing when said central wedge plate is driven between said first and said second wedge actuator, wedging each said wedge actuator and corresponding said fingers laterally outwardly from said actuator housing and thereby urging said lower punch gripping end of each of said punch clamps laterally inwardly in order to selectively grip the at least one punch.

10. The press brake punch holder according to claim 9, wherein at least said central wedge plate comprises a plurality of longitudinally linked components.

11. The press brake punch holder according to claim 9, further including a convex bearing disposed between each of said punch clamp attachment bodies and corresponding said punch clamps.

12. The press brake punch holder according to claim 9, wherein:

said actuator housing and each of said punch clamp attachment bodies are laterally symmetrical and each includes a first side and a second side opposite said first side; and said punch clamps are laterally and generally symmetrically disposed along both said first side and said second side of each of said punch clamp attachment bodies.

13. The press brake punch holder according to claim 9, further including a light compression spring disposed between said upper actuating end of each of said punch clamps and corresponding said punch clamp attachment bodies, in order to retain the at least one punch for manual removal when said central wedge plate is retracted and said first and said second wedge actuator are released.

14. The press brake punch holder according to claim 9, further including:

an attachment adapter adapted for attachment between a press brake ram and said actuator housing, for removably securing said actuator housing to the ram, said attachment adapter having a configuration adapted for direct attachment to the ram and precluding requirement for modification to said actuator housing for attachment to the ram.

15. A press brake punch holder for attaching at least one punch to a reciprocating ram of a press brake, comprising:

an elongate actuator housing having ram attachment means for attachment to the ram of a press brake;

a plurality of punch clamp attachment bodies removably affixed to and depending from said actuator housing;

a plurality of laterally disposed, mutually separate and independent punch clamps pivotally and removably secured to each of said punch clamp attachment bodies;

each of said punch clamps having an upper actuating end, a lower punch gripping end, and a generally centrally disposed fulcrum therebetween;

at least one elongate, flexible, selectively inflatable fluid chamber disposed within said actuator housing;

said fluid chamber having a first side and an opposite second side;

a first pressure plate disposed to said first side of said fluid chamber, and a second pressure plate disposed to said second side of said fluid chamber;

said actuator housing further including a first side and a second side opposite said first side, each having a plurality of laterally disposed actuator passages therethrough; and each said pressure plate further including a plurality of laterally extending fingers disposed through said actuator passages of said actuator housing and communicating with said upper actuating end of each of said punch clamps, for urging said upper actuating end of each of said punch clamps away from said actuator housing when said at least one fluid chamber is selectively inflated, urging each said pressure plate and corresponding said fingers laterally outwardly from said actuator housing and thereby urging said lower punch gripping end of each of said punch clamps laterally inwardly in order to selectively grip at the least one punch.

16. The press brake punch holder according to claim 15, further including a convex bearing disposed between each of said punch clamp attachment bodies and corresponding said punch clamps.

17. The press brake punch holder according to claim 15, wherein:

said actuator housing and each of said punch clamp attachment bodies are laterally symmetrical and each includes a first side and a second side opposite said first side; and said punch clamps are laterally and generally symmetrically disposed along both said first side and said second side of each of said punch clamp attachment bodies.

18. The press brake punch holder according to claim 15, further including a light compression spring disposed between said upper actuating end of each of said punch clamps and corresponding said punch clamp attachment bodies, for retaining the at least one punch for manual removal when said punch clamp actuator assembly is released.

19. The press brake punch holder according to claim 15, further including:

an attachment adapter adapted for attachment between a press brake ram and said actuator housing, for removably securing said actuator housing to the ram, said attachment adapter having a configuration adapted for direct attachment to the ram and precluding requirement for modification to said actuator housing for attachment to the ram.

* * * * *